US006570114B1

(12) United States Patent
Czarnecki

(10) Patent No.: US 6,570,114 B1
(45) Date of Patent: May 27, 2003

(54) CENTER CONTACT AND ROCKER ARRANGEMENT FOR A SINGLE POLE DOUBLE-THROW SWITCH

(75) Inventor: Neil A. Czarnecki, Mt. Pleasant, WI (US)

(73) Assignee: Reliance Controls Corporation, Racine, WI (US)

( * ) Notice: Subject to any disclaimer, the term of this patent is extended or adjusted under 35 U.S.C. 154(b) by 0 days.

(21) Appl. No.: 10/007,018

(22) Filed: Nov. 5, 2001

(51) Int. Cl.[7] ..... H01H 21/80

(52) U.S. Cl. ..... 200/553; 200/557; 200/558; 200/559; 200/339

(58) Field of Search ..... 200/6 R–6 C, 200/405, 410, 416, 449, 452, 431, 437, 439, 553, 557–560, 339

(56) References Cited

U.S. PATENT DOCUMENTS

| | | | | | |
|---|---|---|---|---|---|
| 2,782,279 | A | | 2/1957 | Heusser | 200/6 S |
| 3,225,156 | A | | 12/1965 | Sahrbacker | 200/67 |
| 3,671,693 | A | | 6/1972 | Farrell | 200/67 G |
| 4,168,416 | A | | 9/1979 | Josemans | 200/323 |
| 4,408,105 | A | * | 10/1983 | Tanaka | 200/437 |
| 4,789,766 | A | | 12/1988 | Krause | 200/302.3 |
| 4,814,554 | A | | 3/1989 | Magiera | 200/6 R |
| 5,045,648 | A | * | 9/1991 | Fogleman | 200/43.16 |
| 5,105,059 | A | | 4/1992 | Sorenson et al. | 200/302.3 |
| 5,660,270 | A | * | 8/1997 | Martin et al. | 200/315 |
| 5,735,392 | A | | 4/1998 | Shirasaka | 200/553 |
| 6,175,090 | B1 | | 1/2001 | Blossfeld | 200/558 |
| 6,339,201 | B1 | * | 1/2002 | Balaban et al. | 200/339 |

* cited by examiner

*Primary Examiner*—Michael Friedhofer
(74) *Attorney, Agent, or Firm*—Boyle, Fredrickson, Newholm, Stein & Gratz, S.C.

(57) ABSTRACT

An electrical switch includes a stationary center contact located between spaced apart stationary first and second contacts. The contacts are mounted-within the interior of a housing, and a movable-contact member selectively establishes contact between the stationary center contact and the stationary first contact, and between the stationary center contact and the stationary second contact. The center contact includes a planar upwardly facing contact surface, and the movable contact member includes a central contact area which remains in engagement with the planar contact surface of the center contact and acts as a fulcrum during movement of the movable-contact member between first and second operative positions. The spaced apart stationary first and second contacts define coplanar upwardly facing first and second contact surfaces, respectively, which are at an elevation below the elevation of the contact surface of the stationary center contact. The movable contact member includes first and second contact arms which extend outwardly from the central contact area, and movable first and second contacts are mounted to the first and second contact arms, respectively. The movable first and second contacts each have a thickness which corresponds to the difference in elevation between the contact surface of the center contact and the contact surfaces of the stationary first and second contacts, such that the first and second arms lie in a common plane when the movable contact member is in the first and second operative positions, respectively. An actuator is interconnected with the movable contact member, for providing movement between the first and second operative positions. The actuator includes a biased control member that moves along the first and second arms, for moving the movable contact member between the first and second operative positions. The biased control member is operable to apply downward forces on the first and second contact arms when the movable contact member is in the respective first and second operative positions, to force the central contact area of the movable contact member into contact with the contact surface of the stationary center contact, and also to force the respective movable first and second contacts against the stationary first and second contacts, respectively.

16 Claims, 3 Drawing Sheets

CENTER CONTACT AND ROCKER ARRANGEMENT FOR A SINGLE POLE DOUBLE-THROW SWITCH

BACKGROUND AND SUMMARY OF THE INVENTION

This invention relates to a rocker-type switch commonly known as a single pole double throw switch, and more particularly to an improved construction for a center contact arrangement and a movable contact member for use in such a switch.

A single pole double throw (SPDT) switch typically includes a housing within which first and second stationary contacts are mounted, and a stationary center contact is located between the stationary first and second contacts. A movable contact member or rocker is located within the housing, and selectively connects the center contact to either the first stationary contact or the second stationary contact, in response to operation of an actuator movably mounted to the housing.

The stationary center contact is generally in the form of a "saddle" member on which the movable contact member pivots for movement between its first and second operative positions. The "saddle" construction of the center contact is formed by a generally U-shaped member formed of a conductive material such as copper or brass. The movable contact member is generally V-shaped, defining a central area which engages the edges of the U-shaped center contact. With this construction, the movable contact member moves between the spaced apart edges of the center contact when the movable contact member is moved between its first and second operative positions. This can result in arcing between the edge of the stationary center contact and the facing area of the movable contact member, which causes surface irregularities and resistances which can ultimately result in overheating of the switch.

It is an object of the present invention to overcome the shortcomings of the prior art by providing an electrical switch which maintains constant contact between the movable contact member and the stationary center contact as the movable contact member is moved between first and second operative positions. It is a further object of the invention to provide such an electrical switch which requires relatively minor modifications to prior art switch constructions, while avoiding drawbacks associated therewith. It is a further object of the invention to provide such an electrical switch having a movable contact member that maintains positive contact with the center contact arrangement, without oxidization. Yet another object of the invention is to provide such an electrical switch which includes a unique geometric relationship between the stationary center contact and the stationary first and second contacts, to facilitate movement of the movable contact member between its first and second operative positions and to ensure positive contact of the movable contact member with the stationary center contact and the stationary first and second contacts.

In accordance with the invention, an electrical switch generally includes a housing including a base defining an internal cavity, in combination with a cover engageable with the base and an actuator movably mounted to the cover. A stationary center contact is secured to a lower wall defined by the base, and spaced apart stationary first and second contacts are secured to the lower wall of the base on opposite sides of the stationary center contact.

The stationary center contact defines an upwardly facing substantially planar contact surface, and the stationary first and second contacts also define upwardly facing substantially planar contact surfaces. The contact surfaces of the stationary first and second contacts are disposed below the plane of the upwardly facing contact surface of the stationary center contact. The movable contact member is in the form of a V-shaped member having first and second arms extending outwardly from a common center or vertex. Each of the first and second arms has a contact member secured toward its outer end. The movable contact member of the first arm defines a thickness, and includes a downwardly facing contact surface which is selectively engageable with the upwardly facing contact surface of the stationary first contact. Similarly, a movable contact member is mounted toward the opposite end of the second arm, and includes a downwardly facing contact surface which is selectively engageable with the upwardly facing contact surface of the stationary second contact. The movable second contact defines a thickness equal to that of the movable first contact. The thickness of the first and second movable contacts is substantially equal to the difference in elevation between the contact surface of the stationary center contact and the contact surfaces of the stationary first and second contacts. In this manner, the first and second contact arms extend perpendicularly to a longitudinal axis defined by the switch housing, when the movable contact member is in the first and second operative positions, respectively.

To facilitate conductive contact between the movable contact member and the contact surface of the stationary center contact, at least the portion of the movable contact member that engages the contact surface of the stationary center contact is coated with a conductive coating, such as silver. In this manner, oxidization of the center contact area of the movable contact member is prevented, to ensure conductive contact between the stationary center contact and the movable contact member.

The actuator is preferably in the form of an actuator member pivotably mounted to the housing, which includes a plunger member engaged with the movable contact member for moving the movable contact member between its first and second operative positions in response to pivoting movement of the actuator member. The plunger member is biased outwardly into contact with the movable contact member, to press the center contact area of the movable contact member into engagement with the upwardly facing contact surface of the stationary center contact. The biased plunger further acts to press the movable first and second contact members into engagement with the stationary first and second contacts, respectively, when the movable contact member is in the respective first and second operative positions.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figure 1:
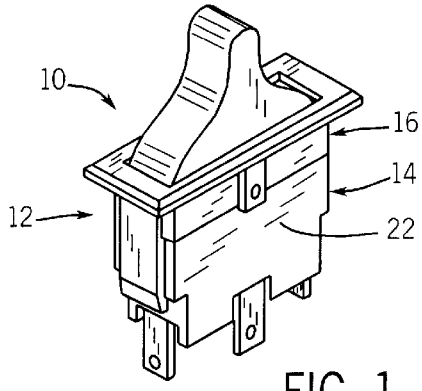
FIG. 1 is an isometric view of an electrical switch incorporating the features of the present invention.
Figure 2:
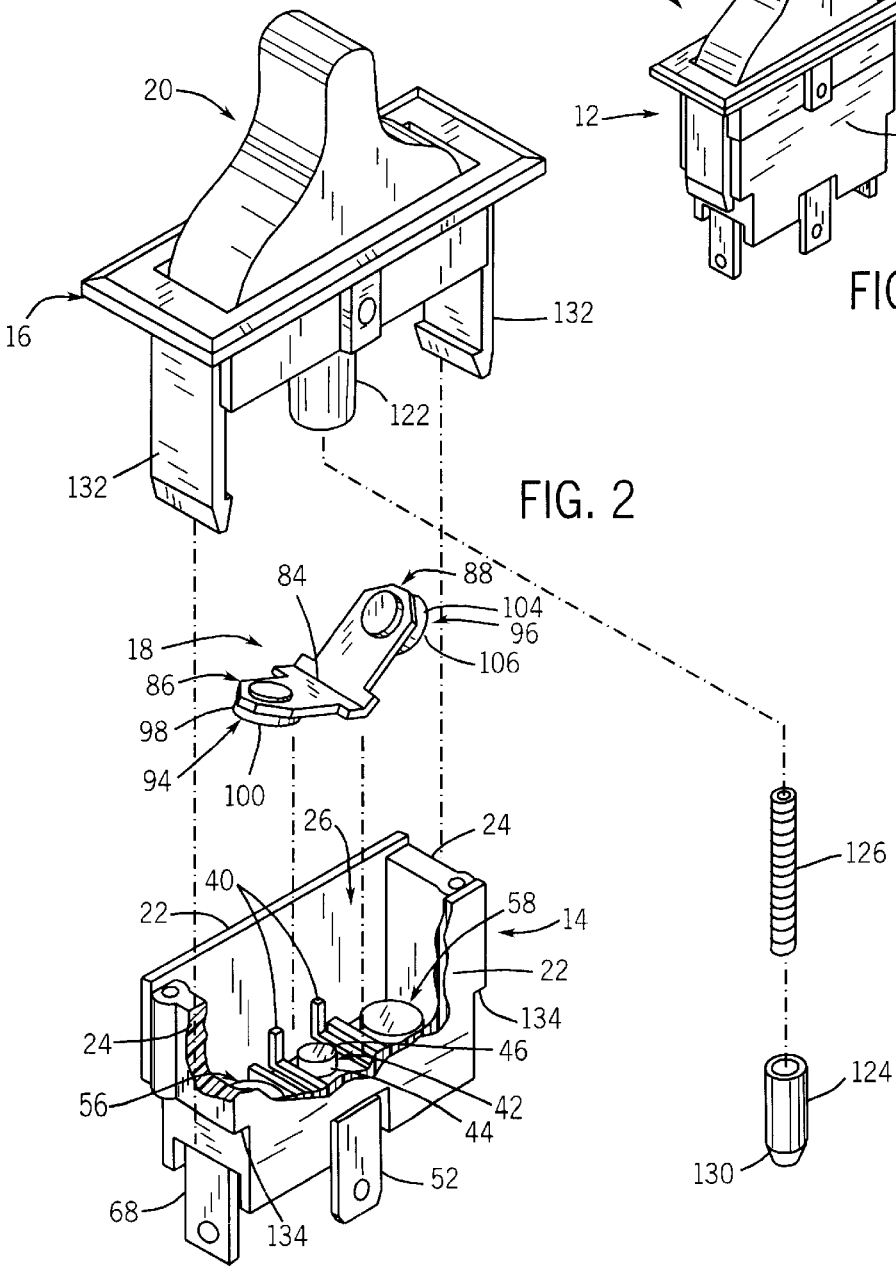
FIG. 2 is an exploded isometric view showing the components of the electrical switch of FIG. 1.
Figure 3:
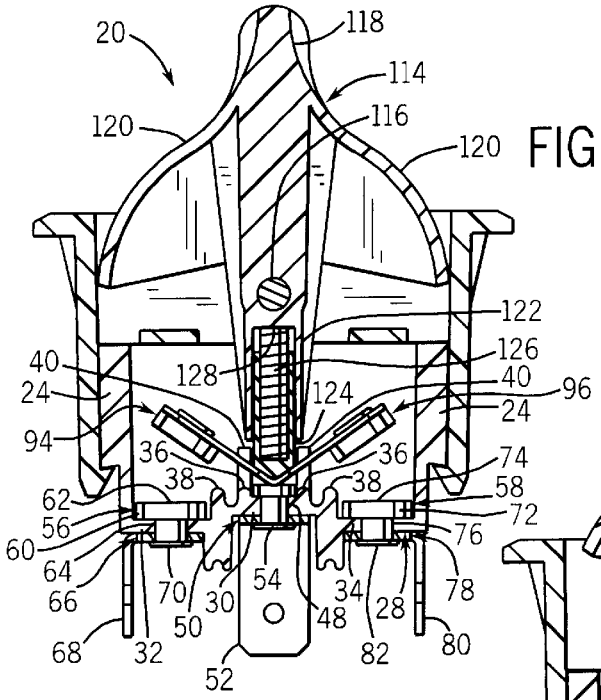
FIG. 3 is a section view through the electrical switch of FIG. 1, showing the movable contact member in an inoperative position.

Referring to FIGS. 1–3, an electrical switch 10 constructed according to the invention generally includes a housing assembly 12 made up of a housing base 14 and a cover 16, a movable contact member 18 and an actuator 20 movably mounted to cover 16.

Housing base 14 includes a pair of spaced apart side walls 22 and a pair of spaced apart end walls 24, which cooperate to define an internal cavity 26. Housing base 14 further includes a bottom wall 28 defining the lower extent of internal cavity 26. As shown in FIG. 3, bottom wall 28 includes a central section 30 in combination with a pair of spaced apart end sections 32, 34. End sections 32, 34 are substantially coplanar, and central section 30 is located above end sections 32, 34. Central section 30 includes a pair of spaced apart inner ribs 36, and an outer rib 38 is spaced outwardly of each inner rib 36. A pair of inwardly extending retaining ridges 40 are formed in each housing base side wall 22. Each retaining ridge 40 extends upwardly from an end of one of the inner ribs 36, such that the retaining ridges 40 on each housing base side wall 22 are spaced apart a distance equal to the spacing between inner ribs 36.

A center contact 42 is mounted to bottom wall central section 30 between inner ribs 36. Center contact 42 includes a contact head 44 defining an upwardly facing center contact surface 46. Center contact 42 is a rivet-type contact, including a shaft 48 that extends through an opening in bottom wall central section 30, and through an aligned opening in a central terminal strip 50 which includes a depending prong 52. A retainer head 54 is formed at the end of shaft 48 opposite contact head 44. In a known manner, retainer head 54 functions to secure both center contact 42 and terminal strip 50 in place on bottom wall 28, and to establish an electrical connection of center contact 42 with terminal strip 50. As illustrated, contact head 44 is located between inner ribs 36, and contact surface 46 of center contact 42 is spaced slightly above the upper extent of inner ribs 36 and outer ribs 38.

In a similar manner, stationary first and second contacts 56, 58 are mounted to housing base 14, and are located on opposite sides of center contact 42. Stationary first contact 56 includes a contact head 60 defining an upwardly facing first contact surface 62 and a shaft 64 that extends through an opening in bottom wall end section 32 and an aligned opening in a terminal strip 66 having a depending contact prong 68. A retainer head 70 is formed at the end of shaft 64 opposite contact head 60, for maintaining stationary first contact 56 and retainer strip 66 in engagement with end section 32 of bottom wall 28, and for establishing electrical contact between terminal strip 66 and stationary first contact 56. Contact head 60 of stationary first contact 56 has a diameter only slightly less than the space between the outer surface of outer rib 38 and the facing inner surface of housing base end wall 24. Upwardly facing contact surface 62 of stationary first contact 56 is located below the upper extent of the adjacent outer rib 38.

Stationary second contact 58 is constructed and arranged similarly to stationary first contact 56, including a contact head 72 defining an upwardly facing contact surface 74, a shaft 76 that extends through aligned openings in end section 34 of bottom wall 28 and in a terminal strip 78 having a depending contact prong 80. A retainer head 82 is formed at the end of shaft 76 opposite contact head 72, for securing stationary second contact 58 and terminal strip 78 to bottom wall 28, and for establishing electrical contact between stationary second contact 58 and terminal strip 78. Contact head 72 has a diameter slightly less than the space between the outer surface of outer rib 38 and the facing inner surface of housing base end wall 24. Upwardly facing contact surface 74 of stationary second contact 58 is located below the upper extent of the adjacent outer rib 38.

Figure 7:
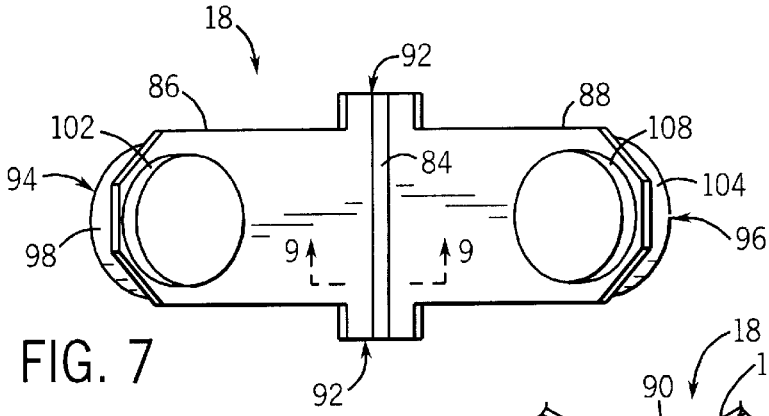
FIG. 7 is a plan view of the movable contact member incorporated into the switch of FIG. 1.

Referring to FIGS. 2, 3 and 7, movable contact member 18 defines a center contact area 84 and first and second contact arms 86, 88, respectively, extending outwardly from center contact area 84 in opposite directions. Movable contact member 18 is generally V-shaped, defining a vertex 90 at the intersection of first and second contact arms 86, 88, respectively. A pair of V-shaped retainer tabs 92 extend outwardly from opposite sides of movable contact member 18. Each retainer tab 92 has a V-shaped cross section and is in the form of an outward extension of vertex 90 and an inner portion of each first and second contact arm 86, 88, respectively, extending outwardly from vertex 90.

A movable first contact 94 is secured toward the outer end of first contact arm 86, and a movable second contact 96 is mounted toward the outer end of second contact arm 88. Movable first contact 94 includes a contact head 98 defining a downwardly facing contact surface 100, and a retainer head 102 that secures movable first contact 94 to first contact arm 86 and establishes an electrical connection therebetween. Similarly, movable second contact 96 includes a contact head 104 defining a downwardly facing contact surface 106, and a retainer head 108 that secures movable second contact 96 to second contact arm 88 and establishes an electrical connection therebetween.

Figure 9:
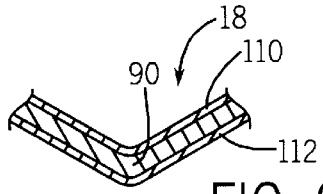
FIG. 9 is a partial section view along line 9—9 of FIG.7.
Figure 8:
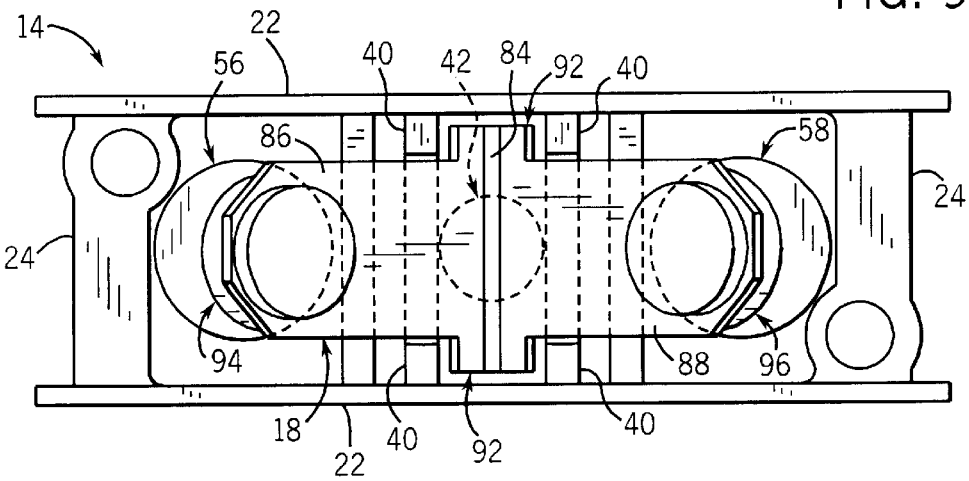
FIG. 8 is a plan view showing the movable contact member of FIG. 7 in position within the base portion of the switch housing, shown in FIG. 6.

Referring to FIG. 9, the upper surface of movable contact member 18 is coated with a conductive coating 110, and the lower surface of movable contact member 18 is coated with a conductive coating 112. Movable contact member 18 is typically formed of an electrically conductive material such as brass or copper, and conductive coatings 110, 112 may be in the form of any satisfactory type of conductive coating that serves to prevent oxidation of the underlying conductive material of movable contact member 18. Representatively, conductive coatings 110, 112 may be in the form of a plating of fine silver applied to all surfaces of movable contact member 18. Conductive coatings 110, 112 facilitate electrical contact between movable first and second contacts 94, 96 and respective first and second contact arms 86, 88. In addition, when movable contact member 18 is installed such that center contact area 84 engages center contact surface 46 of center contact 42, the area of lower conductive coating 112 that underlies vertex 90 and the adjacent areas of first and second contact arms 86, 88, respectively, forms the electrical contact of movable contact member 18 with contact surface 46.

Referring to FIGS. 1 and 3, actuator 20 includes an actuator member 114 pivotably mounted to and between a pair of spaced apart side walls defined by housing cover 16 by means of a pivot pin 116 extending therebetween. Actuator member 122 includes a manually engageable actuator tab 118 and a pair of wings 120 that extend downwardly and outwardly in opposite directions from actuator tab 118. Wings 120 function to enclose internal cavity 36 of housing base 24 when housing cover 16 and actuator 20 are engaged with housing base 24. Actuator member 114 further includes a barrel section 122 located inwardly of pivot pin 116. Barrel section 122 defines an internal passage within which a plunger member 124 is located. Plunger member 124 extends outwardly from the outer end of barrel section 122 and defines an internal passage within which a spring 126 is received. Spring 126 bears between the end of the plunger passage and the end of the barrel passage, shown at 128, for biasing plunger member 124 outwardly relative to barrel section 122. At its outer end, plunger member 124 defines a conical tip 130 having angled side walls that match the angle between first and second contact arms 84, 86, respectively.

In a known manner, housing cover 16 includes a pair of fingers 132 configured to engage detent surfaces 134 formed on housing base end walls 24, for securing housing cover 16 and actuator 20 to housing base 14.

In operation, electrical switch 10 can be connected in a circuit in which a power source is interconnected with center contact 42 and an electrical load is connected to each of first and second contacts 56, 58, respectively. Alternatively, electrical switch 10 may be employed as a transfer switch, in which a pair of separate power sources are connected to each of stationary first and second contacts 56, 58, respectively, and a single electrical load is interconnected with center contact 42. Actuator 20 is movable relative to housing 12 so as to move movable contact member 18 between an inoperative position as shown in FIG. 3, a first operative position as shown in FIG. 4 and a second operative position as shown in FIG. 5.

When movable contact member 18 is in the inoperative position of FIG. 3. actuator member 114 is positioned such that barrel section 122 extends coaxially with a longitudinal axis defined by housing base 14, which is coincident with the longitudinal axis of center contact shaft 48. Plunger member 124 thus applies a downward force on center contact area 84 of movable contact member 18. The mating engagement of conical tip 138 of plunger member 124 with the central upper surfaces of center contact area 84 functions to maintain movable contact member 18 in its inoperative position, in which both movable first contact 94 and movable second contact 96 are maintained out of contact with respective stationary first and second contacts 56, 58.

Figure 4:
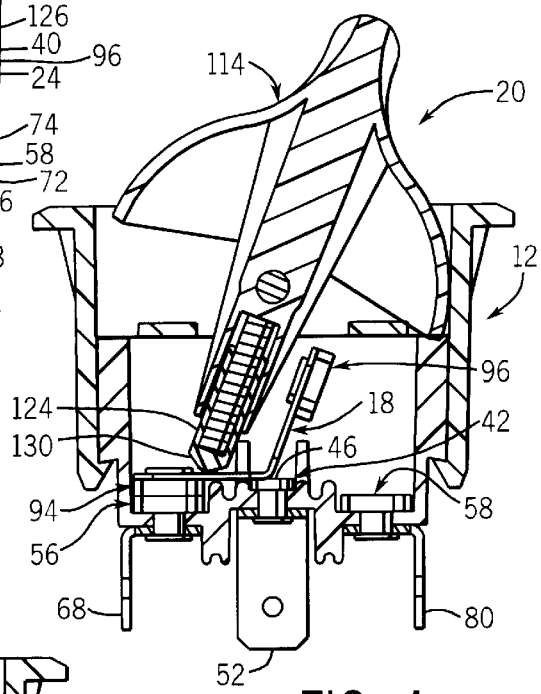
FIG. 4 is a view similar to FIG. 3, showing the movable contact member in a first operative position.
Figure 5:
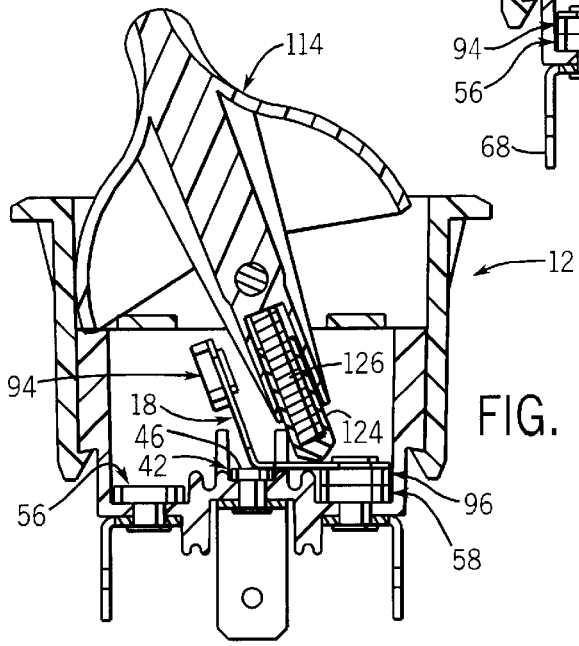
FIG. 5 is a view similar to FIGS. 3 and 4, showing the movable contact member in a second operative position.
Figure 6:
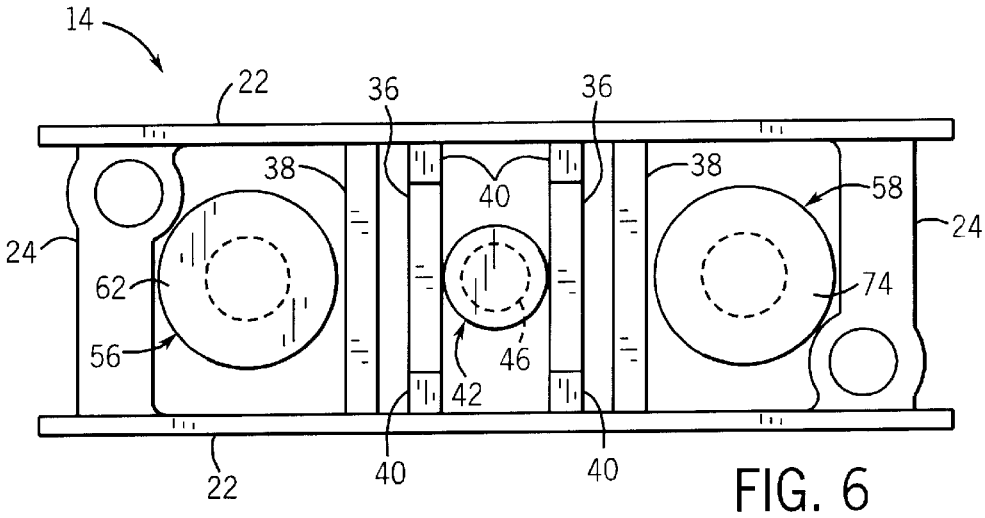
FIG. 6 is a plan view of a base portion of the housing of the switch of FIG. 1, showing the stationary center contact and the spaced apart stationary first and second contacts.

To place movable contact member 18 in its first operative position of FIG. 4, actuator member 114 is pivoted in a clockwise direction about pivot pin 116 by application of a manual force to actuator tab 118. This causes barrel section 122 to move away from center contact area 84 of movable contact member 18, and along the upper surface of first contact arm 86. The outward bias applied to plunger member 124 by spring 126 applies a downward force on first contact arm 86, such that movable first contact 94 is moved downwardly into engagement with contact head 60 of stationary first contact 56. During such movement, vertex 90 of movable contact member 18 acts as a fulcrum about which movable contact member 18 is moved, maintaining engagement of vertex 90 with contact surface 46 of center contact head 44.

The thickness of contact head 98 of movable first contact 94 is equivalent to the difference in elevation between contact surface 46 of center contact head 44 and contact surface 62 of first contact head 60. In this manner, first contact arm 86 of movable contact member 18 extends transversely relative to the longitudinal axis of housing base 14, and parallel to center contact surface 46 of center contact head 44, when movable contact member 18 is in its first operative position of FIG. 4. This arrangement functions to create contact between center contact surface 46 and the inner portion of center contact area 84 adjacent vertex 90 when movable contact member 18 is in its first operative position, to maximize the area of contact between stationary center contact 42 and first contact arm 86. Further, the conductive coating 112 on the outer surface of movable contact member 18 also enhances the conductive contact between stationary center contact 42 and movable contact member 18, which otherwise may form a nonconductive oxidized coating over time.

The downward component of the force applied to first contact arm 86 by plunger member 124 and spring 126 results in a downward force of center contact area 84 on center contact surface 46, as well as a downward force that engages contact surface 100 of movable first contact 94 with upwardly facing contact surface 62 of stationary first contact 56.

In order to connect stationary center contact 42 with stationary second contact 58, actuator member 114 is pivoted in a counterclockwise direction about pivot pin 116, to first place movable contact member 18 in its inoperative position of FIG. 3. Continued counterclockwise pivoting movement of actuator member 114 causes conical tip 130 of plunger member 124 to slide along the inner surface of second contact arm 88, to rock movable contact member 18 to its second operative position of FIG. 5. Again, vertex 90 of movable contact member 18 acts as a fulcrum to provide such movement of movable contact member 18 to its second operative position, to maintain movable contact member 18 in constant contact with contact surface 46 of center contact head 44. When movable contact member 18 is placed in its second operative position of FIG. 5, second contact arm 88 is positioned similarly to first contact arm 86 when movable contact member 18 is in its first operative position of FIG. 4. That is, second contact arm 88 extends parallel to the plane of center contact surface 46, to provide contact between center contact surface 46 and the inner area of second contact arm 88 adjacent vertex 90. Again, plunger member 124 applies downward forces on movable second contact 96 into engagement with stationary second contact 58, which also are applied to the inner portion of second contact arm 88 adjacent vertex 90.

The horizontal position of each of first and second contact arms 86, 88, respectively, when movable contact member 18 is in the first and second operative positions, respectively, provides maximum contact area between movable contact member 18 and stationary center contact 42. The downward biasing force applied by plunger member 124 ensures constant contact of center contact area 84 of movable contact member 18 with center contact surface 46 at all times, including when movable contact member 18 is in either its first or second operative positions. The conductive coating applied to movable contact member 18 provides good electrical contact and prevents oxidization.

The location of retainer tabs 92 of movable contact member 18 between retaining ridges 40 of housing base 14 functions to maintain the position of movable contact member 18 relative to housing base 14 during movement of movable contact member 18. In this manner, movable contact member 18 is allowed to pivot on the flat center contact surface 46 of stationary center contact 42 in a manner such that center contact area 84 of movable contact member 18 acts as a fulcrum, to ensure constant, high quality contact of center contact area 84 with center contact surface 46.

Various alternatives and embodiments are contemplated as being within the scope of the following claims particularly pointing out and distinctly claiming the subject matter regarded as the invention.

I claim:

1. An electrical switch, comprising:

a housing defining an interior;

spaced apart first and second stationary contacts mounted to the housing and located within the housing interior;

a stationary center contact mounted to the housing and located within the housing interior, wherein the center contact is located between the stationary first and second contacts;

wherein each of the stationary first and second contacts defines a substantially planar contact surface, and wherein the contact surfaces of the stationary first and second contacts are substantially coplanar, and wherein the stationary center contact defines a substantially planar center contact surface located at an elevation above the plane of the contact surfaces of the stationary first and second contacts;

a movable contact member located within the interior of the housing, wherein the movable contact member is movable between a first operative position in which the movable contact member establishes contact between the stationary center contact and the stationary first contact, and a second operative position in which the movable contact member establishes contact between the stationary center contact and the stationary second contact, wherein the movable contact member comprises intersecting first and second contact arms, wherein a movable first contact is secured to the first contact arm and wherein a movable second contact is secured to the second contact arm, wherein the movable first contact defines a contact head having a downwardly facing contact surface engaging the contact surface of the stationary first contact when the movable contact member is in the first operative position, and wherein the movable second contact includes a contact head having a downwardly facing contact surface engaging the contact surface of the stationary second contact when the movable contact member is in the second operative position, wherein the first and second contact heads each define a thickness substantially equal to a difference in elevation between the plane of the contact surfaces defined by the stationary first and second contacts and the plane of the contact surface defined by the stationary center contact, and wherein the movable contact member defines a center contact area which remains in engagement with the planar contact surface of the stationary center contact during movement of the movable contact member between the first and second operative positions; and an actuator associated with the housing for moving the movable contact member between the first and second operative positions.

2. The electrical switch of claim 1, wherein the movable contact member is formed of an electrically conductive material, and further comprising a conductive coating applied to at least the center contact area of the movable contact member which engages the contact surface of the stationary center contact, for enhancing conductive contact between the movable contact member and the stationary center contact.

3. The electrical switch of claim 2, wherein the conductive coating is applied throughout the surface area of the movable contact member.

4. The electrical switch of claim 1, wherein the center contact area of the movable contact member comprises first and second intersecting walls, wherein the first wall is configured so as to be coplanar with the contact surface of the stationary center contact when the movable contact member is in the first operative position, and wherein the second wall is configured so as to be coplanar with the contact surface of the stationary center contact when the movable contact member is in the second operative position.

5. The electrical switch of claim 4, wherein a lower surface defined by the first contact arm is substantially coplanar with the contact surface of the stationary center contact when the movable contact member is in the first operative position, and wherein a lower surface defined by the second contact arm is substantially coplanar with the contact surface of the stationary center contact when the movable contact member is in the second operative position.

6. The electrical switch of claim 1, wherein the actuator comprises a movable actuator member having an outwardly biased control member that engages the movable contact member for providing movement of the movable contact member between the first and second operative positions.

7. The electrical switch of claim 6, wherein the biased control member comprises an outwardly biased plunger member disposed within a passage defined by the actuator member, wherein the plunger member includes an outer end that engages the movable contact member and moves along the first and second contact arms of the movable contact member for moving the movable contact member between the first and second operative positions.

8. The electrical switch of claim 7, wherein the outer end of the plunger member has a configuration which matches a configuration of an inner section of the center contact area, wherein engagement of the outer end of the plunger member with the inner section of the center contact area functions to place the movable contact member in an inoperative position in which both the movable first and second contacts are maintained out of engagement with the respective stationary first and second contacts.

9. An electrical switch, comprising:

a housing defining an interior;

a series of contacts mounted within the housing interior, including spaced apart stationary first and second contacts and a stationary center contact located therebetween, wherein the center contact includes an upwardly facing planar center contact surface;

a movable contact member located within the housing interior, wherein the movable contact member includes a central contact area engaged with the planar contact area of the center contact, and first and second contact arms extending outwardly from the central contact area, wherein a first contact member is mounted to the first contact arm and wherein a second contact member is mounted to the second contact arm; and an actuator associated with the housing and engaged with the movable contact member for causing movement of the movable contact member between a first operative position in which the central contact area of the movable contact member is engaged with the contact surface of the center contact and the movable first contact is engaged with the stationary first contact, and a second operative position in which the central contact area of the movable contact member is engaged with the contact surface of the center contact and the movable second contact is engaged with the stationary second contact, wherein the actuator includes a biased control member which moves along the first and second contact arms and the central contact area for moving the movable contact member between the first and second operative positions.

10. The electrical switch of claim 9, wherein the central contact area of the movable contact member remains in engagement with the contact surface of the center contact and defines a fulcrum about which the movable contact member is movable between the first and second operative positions.

11. The electrical switch of claim 10, wherein at least a portion of the central contact area of the movable contact member that engages the contact surface of the center contact is provided with a conductive coating for facilitating electrical contact between the movable contact member and the center contact.

12. The electrical switch of claim 10, wherein the stationary first and second contacts define coplanar first and second contact surfaces, respectively, wherein the contact surface of the center contact is located in a plane above the plane of the first and second contact surfaces.

13. The electrical switch of claim 12, wherein each of the movable first and second contacts defines a thickness substantially equal to a difference in elevation between the plane of the stationary center contact surface and the plane of the contact surfaces of the stationary first and second contacts.

14. The electrical switch of claim 10, wherein the actuator includes a barrel section defining a passage, and wherein the biased control member comprises a plunger member movably mounted within the barrel section passage, wherein a spring is interposed between the barrel section and the plunger member for biasing the plunger member outwardly into contact with the movable contact member.

15. The electrical switch of claim 14, wherein the plunger member defines an end area having a configuration which matches an inner portion of the central contact area of the movable contact member, wherein engagement of the end area of the plunger member with the inner portion of the central contact area functions to position the movable contact member in an inoperative position wherein the movable first and second contacts are maintained out of engagement with the respective stationary first and second contacts.

16. The electrical switch of claim 14, wherein each of the first and second contact arms of the movable contact member are oriented in a transverse horizontal orientation when the movable contact member is in the first and second operative positions, respectively, wherein engagement of the biased plunger member with the respective first and second contacts arms of the movable contact member functions to apply a downward force on the first and second contact arms when the movable contact member is in the first and second operative positions, respectively.

* * * * *